US007993156B2

(12) United States Patent
Holste

(10) Patent No.: US 7,993,156 B2
(45) Date of Patent: Aug. 9, 2011

(54) CONNECTING TERMINAL FOR PRINTED CIRCUIT BOARDS

(75) Inventor: Dieter Holste, Detmold (DE)

(73) Assignee: Phoenix Contact GmbH & Co. KG (DE)

( * ) Notice: Subject to any disclaimer, the term of this patent is extended or adjusted under 35 U.S.C. 154(b) by 0 days.

(21) Appl. No.: 12/294,702

(22) PCT Filed: Mar. 28, 2007

(86) PCT No.: PCT/EP2007/002737

§ 371 (c)(1),
(2), (4) Date: Jun. 30, 2009

(87) PCT Pub. No.: WO2007/112899

PCT Pub. Date: Oct. 11, 2007

(65) Prior Publication Data

US 2010/0173531 A1 Jul. 8, 2010

(30) Foreign Application Priority Data

Mar. 28, 2006 (DE) ..... 10 2006 014 646

(51) Int. Cl.
*H01R 4/26* (2006.01)

(52) U.S. Cl. ..... 439/441

(58) Field of Classification Search ..... 439/439–441, 439/352, 374

See application file for complete search history.

(56) References Cited

U.S. PATENT DOCUMENTS

| | | | | |
|---|---|---|---|---|
| 2,713,668 | A | 7/1955 | Gibilisco | |
| 5,679,021 | A * | 10/1997 | Kramer | 439/835 |
| 6,527,601 | B2 * | 3/2003 | Chen | 439/852 |
| 7,238,043 | B2 * | 7/2007 | Reibke et al. | 439/441 |

FOREIGN PATENT DOCUMENTS

| | | |
|---|---|---|
| DE | 7801829 | 6/1981 |
| DE | 29920231 | 4/2001 |
| DE | 20205821 | 8/2003 |
| DE | 102004045026 | 2/2006 |
| EP | 0632529 | 1/1995 |
| EP | 1309036 | 5/2003 |
| ES | 2006024678 | 3/2006 |
| JP | 09073927 | 3/1997 |
| JP | 10012294 | 1/1998 |

OTHER PUBLICATIONS

International Search Report for PCT/EP2007/002737, Jul. 9, 2007, EPO.

* cited by examiner

*Primary Examiner* — Renee S Luebke
*Assistant Examiner* — Larisa Z Tsukerman
(74) *Attorney, Agent, or Firm* — Bourque and Associates, PA

(57) ABSTRACT

A contact insert for a connecting terminal of a multiplicity of mutually isolated connection elements, designed in particular for printed circuit boards, with a spring force element being mounted symmetrically, with the spring force element designed with a simple section geometry and its simple mounting together with the advantageous connection to the contact insert, results in a closed terminal cage which makes it possible to reduce the physical height of the dielectric housing to a major The connecting terminal is used as a linking element in printed circuit board connection technology for providing a reliable supply to industrial electronics and economic individual wiring on printed circuits.

19 Claims, 3 Drawing Sheets

CONNECTING TERMINAL FOR PRINTED CIRCUIT BOARDS

TECHNICAL FIELD

The present invention relates in general to the field of electrically conductive physical connections and more particularly, to a connector providing a physical connection of a multiplicity of mutually isolated connection elements, designed in particular for printed circuits, with the physical connections representing a component of an electrical connection between two or more conductive elements, using a spring.

BACKGROUND INFORMATION

As is known from the state-of-the-art, connecting terminals, in particular a plug-type connector for electrical contacting and for attachment to a printed circuit board equipped with a base strip or electrical equipment or the like, for at least one electrical conductor, are available in many designs, for example in single-pole or multi-pole designs, with a housing made of insulating material either in block or modular design, where the housing made of insulating material exhibits at least one insertion opening for inserting an electrical conductor, at least one insertion opening for inserting a contact pin into the socket contact and an opening for the actuating means in the form of a push element for opening the terminal point by applying an actuating tool, as well as a receiving space for receiving a spring force element and a contact insert that fulfills several functions.

Such connecting terminals, in particular plug-type connectors, are sufficiently known from the state-of-the-art and may be obtained, for example, from the product catalog "Leiterplattenanschluss COMBICON 2005" ["Printed circuit board connector COMBICON 2005" TNR 5169412/31.12.2004-00 of the company Phoenix Contact GmbH & Co KG,] with such plug-type connectors in spring force connection technology being available for almost every type of connection in building services engineering and telecommunications. All connecting terminals, in particular plug-type connectors of this kind, are characterized by an excellent clamping capacity, space-saving dimensions and versatility in the field of connection technology. One design series of these plug-type connectors is the spring force connecting terminal in leg spring design.

Plug-type connectors of this kind are mass-produced articles. This supports the demand for, on the one hand, the ability to establish connections fast and without problems, and, on the other hand, for the individual components of the plug-type connectors to be manufactured cost-effectively, taking into account the directives and standards for electrically conducting components, to be easily machine-customizable, and, taking into account the developmental requirements for dimensioning, to reduce the installation size of the insulating housing of the connecting terminals, in order to adapt the plug-type connectors to the ever shrinking installation size on printed circuit boards.

Thus, there is a demand for the components to be manufactured and processed efficiently and to meet the higher quality demands in order to satisfy the various areas of applications. Thus, each component shall be optimized in its function and a closed system shall be created, where the contacting spring force element is connected with the electrically conducting connection surface, the bus bar, such that a contact is established independent of an insulating housing, and, therefore, a shifting movement of the spring force element due to softening and deformation of the insulating housing at high temperatures is excluded.

Known from DE 28 02 686, which is viewed as the closest state-of-the-art, is a spring terminal for the plug-type connection of several electrical conductors to a bus bar using a compression spring that presses the conductors onto the bus bar, whereby the compression springs exhibit blades of the base web of an approximately U-shaped spring element with said blades being angled and at a distance to each other and where the legs of said spring element can contact the bus bar and an insulating housing covering said bus bar. Although this known arrangement is provided for several terminal points, it is fundamentally not suitable as a connecting terminal for printed circuit board technology. The disadvantage is that a quick disconnect of the individual terminal connections is not provided by the characteristic lever opener.

SUMMARY OF THE INVENTION

It is, therefore, an objective of the invention to provide a connecting terminal of the kind mentioned above, which avoids the disadvantages of the known arrangements of the state-of-the-art as mentioned above and to provide a technical solution that enables the manufacture of a connecting terminal with a simple functional design and small installation size, which can be customized easily and quickly, and where the clamping contact occurs independent of the insulating housing, for the printed circuit board connection.

The invention features a plug-type connector (2) for electrical contacting and for attachment to a printed circuit board (4) equipped with a base strip (5), for at least one electrical conductor (6), the connector having a housing made of insulating material (3) either in block or modular design, with at least one actuating means (8) made of synthetic material, with at least one spring force element (11), consisting of a leg spring (13) that is punched out of and formed of a strip of material for clamping an electrical conductor (6), with at least one contact insert (14), consisting of a bus bar (16) that is punched out of and formed of an electrically conductive strip of material, whereby the bus bar (16) exhibits a contact area (17) for the electrical conductor (6) and a contact element (18) for plugging the connecting terminal (1) onto a contact pin (7) as well as means (19) for mounting in the insulating housing (3), characterized in that the spring force element (11) includes means for simultaneous physical and electrical attachment to said contact insert (14).

A plug-type connector (2) my be further characterized in that the means for simultaneous physical and electrical attachment of said spring force element (11) to said contact insert (14) may include geometrically arranged retaining clips or legs (46), while the means for simultaneous physical and electrical attachment of said spring force element (11) to said contact insert (14) includes protrusions (22). The protrusions (22) are designed with a rectangular or square cross-section.

A plug-type connector (2) may be characterized in that the spring force element (11) consists of a set of springs. A plug-type connector (2) may also be characterized in that the set of springs consists of at least two leg springs (13).

A plug-type connector (2) as disclosed herein may be further characterized in that the leg springs (12) used in the set of springs exhibit the same or different contours.

In one embodiment, the contact insert (14) is punched out of and formed in one piece of an electrically conducting strip of material (15), and wherein it forms a bus bar (16). The contour of the bus bar (16) may be formed of numerous end pieces (31, 32, 33, 34, 35). Two end pieces (31, 32) may be arranged on the center axis of the strip of material (15) while two end pieces (31, 33) may form a contact element (18). Three end pieces (32, 34, 35) may form a u-shaped spring cage (45).

The end piece (32) may exhibit guide bars (48) on the side. The guide bars (48) serve as a guide for the moveable leg (24) of the spring force element (11) and as a guide for the electrical conductor (6). The end piece (32) may include breakthroughs (50).

An attachment means (19) may be arranged at the end piece (32). The attachment means (19) may consist of a snap-in hook (49). The u-shaped spring cage (45) may exhibit two retaining clips (46) for holding the spring force elements (11) while the retaining clips (46) exhibit openings (47) for receiving a protrusions (22) of the spring force element (11). The shape of the opening (47) forms a longitudinal hole (51) that preferably has a rectangular cross-section and wherein the size of the opening (47) corresponds to a material thickness of the spring force element (11).

In order to manufacture a connecting terminal with these features of the present invention in spring force technology for a quick, reliable and universal clamping connection in a miniaturized design, taking into account the wiring requirements of the device manufacturers and printed circuit board processors, it is recommended, according to the invention, to produce a plug-type connector that, on the one hand, reliably ensures an optimal electrical contact and, on the other hand, allows for a reduction in the installation size. Plug-type connectors are characterized by space-saving designs, quick connection technology due to the spring force and have no locking mechanism between plug and base or pin strip. The universal usability of the connecting terminals relates to both vertical and horizontal plug directions of the plug-type connector in connection with the base strip and the electrical conductors to be connected with them to the printed circuit board.

The fast and reliable clamping connection shall occur through the spring force technology which is based on the quick connection of the electrical conductor or of the electrical conductors without the need for special tools. The clamping system is based on the leg spring method and can clamp one or more electrical conductors of the same or of different potentials.

The main objectives are the reduction of the installation size of the insulating housing and the manufacture of simple components that can be customized easily and quickly.

All requirements mentioned above shall be combined in a connecting terminal, in particular in a plug-type connector.

According to the invention, these objectives are solved by the development of a plug-type connector that ensures the advantages of the spring force technology and the advantages of the high clamping reliability through a reliable mechanical connection and a reliable electrical contact combined with the continued miniaturization of the assembly in order to increase at the same time the component density on the printed circuit board.

As a rule, a connecting terminal, in particular a plug-type connector, consists of an insulating housing, a contact insert, a spring force element and, depending on the design, may or may not be equipped with a lever opener. A plug-type connector according to the art of the invention exhibits a one-piece contact insert that is punched out of a flat electrically conducting strip material with the strip material being made of a high-quality copper alloy resistant to stress corrosion cracking in order to prevent interference with the current transfer.

According to the invention, after punching out numerous end pieces, preferably five end pieces are formed at the strip material. The strip material has the task to, on the one side, serve as a bus bar and provide an optimal contact surface for the electrical conductor to be connected, and, on the other side, to form, for example in the base strip, from the end pieces a contact element serving as a socket contact for connecting a contact pin. According to the invention, additional end pieces serve as a means of attachment for the spring force element with the end pieces as the means of attachment forming a u-shaped spring cage. The u-shaped spring cage exhibits two retaining clips that include openings for receiving the retaining means of the spring force element, whereby the retaining means of the spring force element consist of protrusions that engage in the openings of the retaining clips of the spring cage. The u-shaped spring cage is pre-stressed such that it rests against the contact surfaces of the leg spring without an installation gap. The assembly assembled in this manner provides sufficient stability for installation in the associated insulating housing without the need for additional measures. The deflection of the spring force element occurs upon insertion of a sufficiently bend-resistant electrical conductor and/or by using an actuation means, preferably a spring push element that can be operated using a commercial actuation tool and that is located in the insulating housing. The spring force element can also be formed from a set of springs with the set of springs being comprised of individual leg springs. According to the invention, this advantage is made possible by the different sizes of the openings in the retaining clips of the contact insert. The embodiment of the contact insert subject to the invention with symmetrical mounting of the spring force elements, the spring force element designed according to the invention with simple sectional geometry and its simple assembly together with the advantageous connection with the contact insert result in a closed terminal cage, which makes it possible to reduce the installation height of the insulating housing significantly. Thus, the insulating housing made of a thermoplastic material by injection molding can be adapted optimally in its design to the electrical insulating properties.

BRIEF DESCRIPTION OF THE DRAWINGS

These and other features and advantages of the present invention will be better understood by reading the following detailed description, taken together with the drawings wherein.

DETAILED DESCRIPTION OF THE PREFERRED EMBODIMENTS

Figure 1:
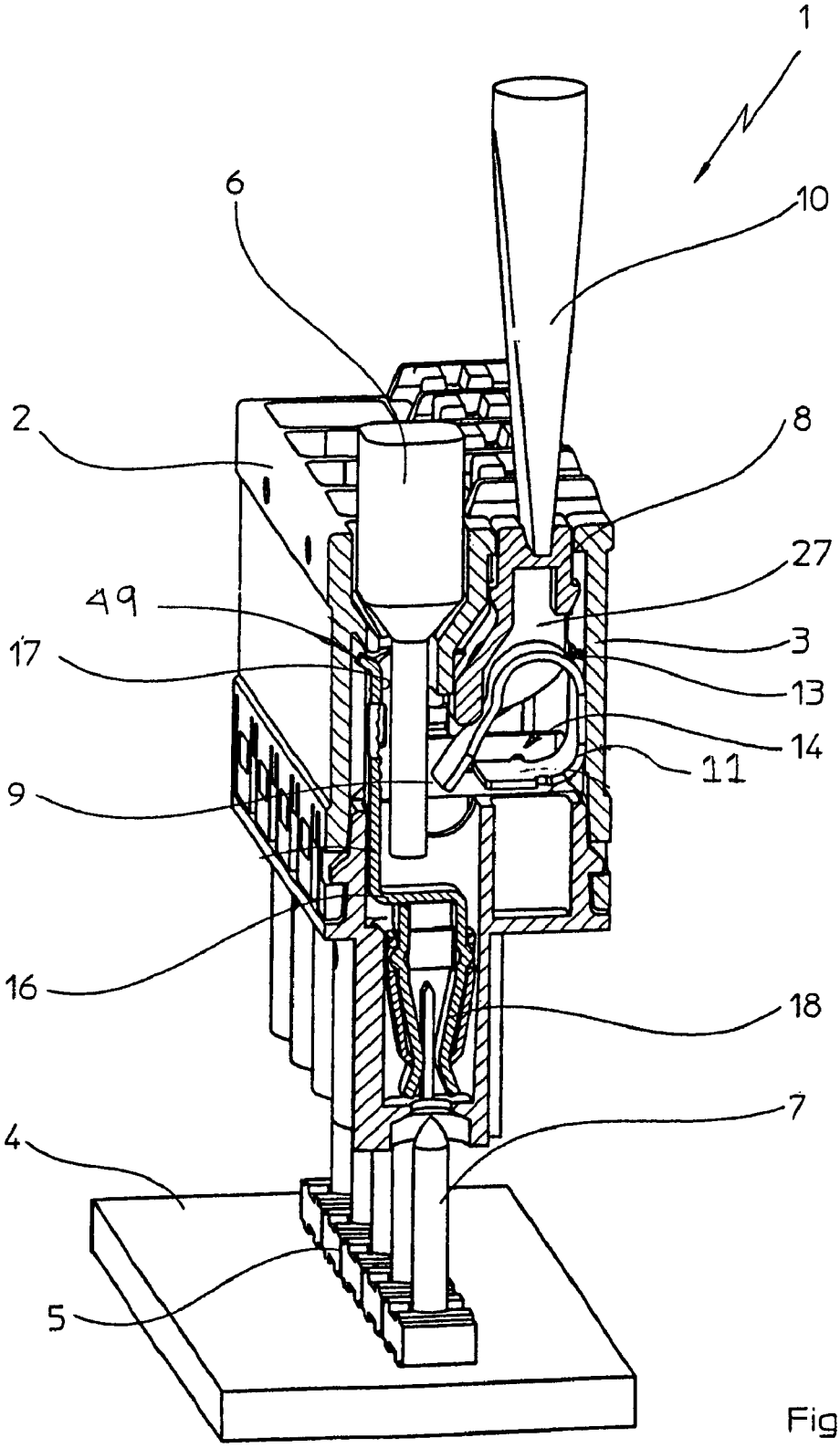
FIG. 1 is a perspective sectional presentation of a connecting terminal with a base strip mounted on a printed circuit board.

FIG. 1 presents in a perspective sectional view of an advantageous embodiment of the connecting terminal 1 according to the invention in a complete form according to the type-defining kind of a plug-type connector 2 in a miniaturized embodiment of the insulating housing 3 in block design, where said embodiment can be plugged onto a printed circuit board 4 with a mounted base strip 5, with the base strip 5 exhibiting a pole number of two to twelve, and being mounted either in a vertical or horizontal plug-in direction in relation to the printed circuit board utilizing, for example, a through hole reflow solder method as is well known in the art.

The connecting terminal 1 consists of an insulating housing 3, where the insulating housing 3 in block design is divided into two housing sections, an upper and a lower section, and forms a receiving space 27. The receiving space 27 includes at least one actuation means 8, preferably a push element made of plastic, for opening the terminal point 9 by applying pressure with an actuation tool 10. At least one spring force element 11, consisting of a leg spring 13 punched and formed from a strip of material, preferably a spring steel strip, for clamping an electrical conductor 6. At least one contact insert 14, consisting of a bus bar 16 punched and formed from an electrically conductive strip material 15, is provided whereby the bus bar 16 exhibits a contact surface 17 for the electrical conductor 6 and a contact element 18 as a socket contact for plugging the connecting terminal 1 onto a contact pin 7 as well as means 19 for attaching the insulating housing 3. The design of the embodiment, according to the invention, of the spring force element 11 and of the contact insert 14 can be seen in greater detail in FIGS. 2 and 3.

Figure 2:
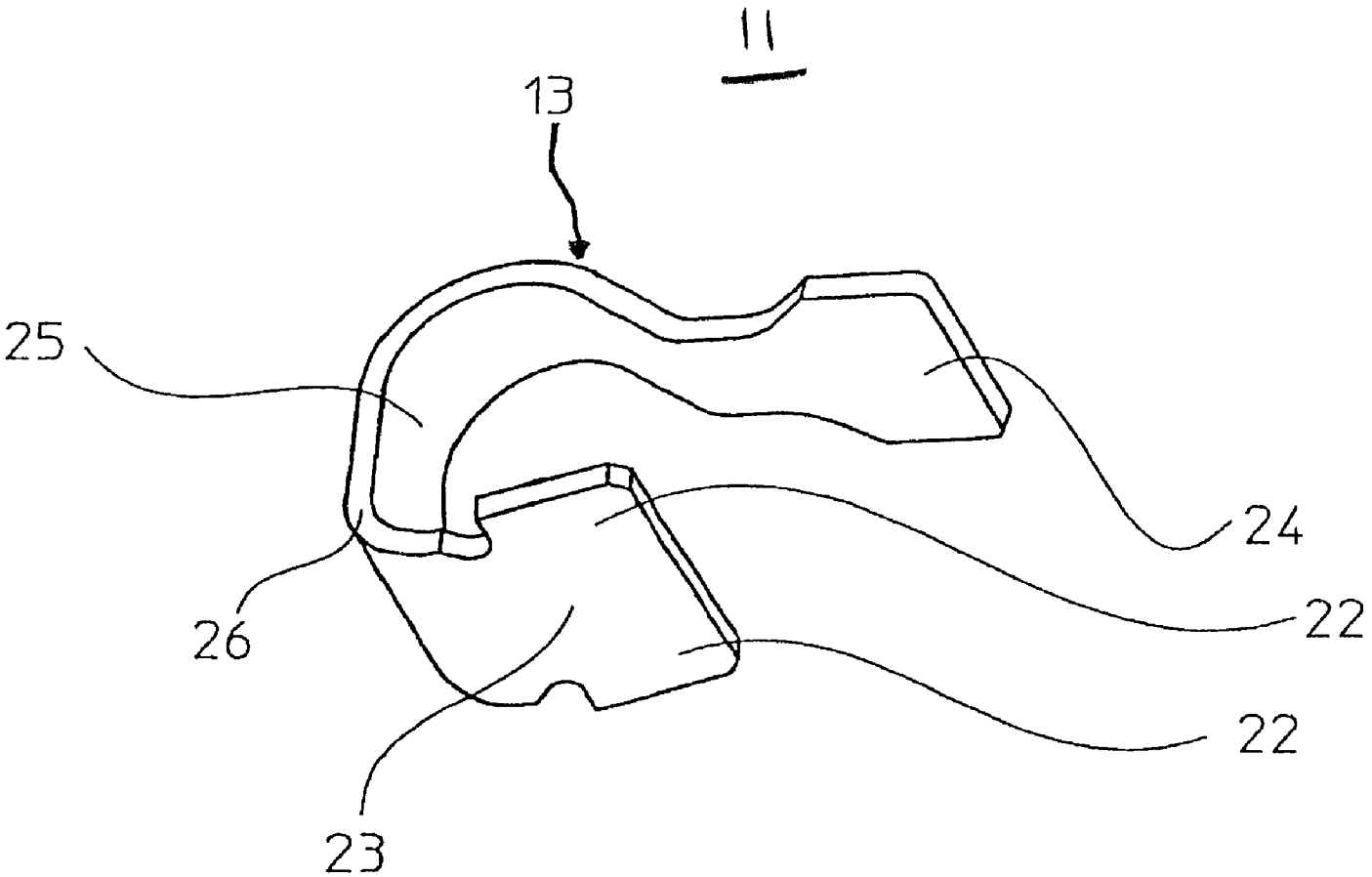
FIG. 2 is a perspective presentation of a spring force element subject to the invention.

FIG. 2 is a perspective presentation of an advantageous embodiment of a spring force element 11 according to the invention consisting of a single leg spring 13, where the spring force element 11 may also be comprised of a set of springs (not shown). The set of springs can be comprised of several individual leg springs 13, preferably of two leg springs 13. The leg springs 13 employed in the set of springs can exhibit the same contour but also different contours. With the same contours, different thicknesses of the strips of material can be used which allows for setting different forces at the terminal point of the connecting terminal. For example, with the same connecting terminal, the clamping force required for the application can be set individually by the respective selected leg spring 13, resulting in a dependable mechanical connection and a reliable contact for the conductor connection. In this context, individually refers to responding to the different electrical conductors 6 that can be clamped in the form of solid conductors, i.e., either rigid (one- or multi-strand) or flexible (fine or finest stranded) conductors with or without wire-end sleeve can be clamped. For example, a connecting terminal 1 may be equipped with a contact insert 14 and spring force element 11 for connecting a rigid electrical conductor 6, which may contain a different spring force elements 11 for fine-stranded conductors 6 of the same conductor cross-section.

In the condition without pre-stress, the shape of the leg spring 13, which is formed of two leg portions 23, 24, corresponds approximately to a "U" with the legs 23, 24 of different lengths. At the apex is a u-shaped connecting loop 25. The u-shaped loop 25 of the formed leg spring 13 serves the flexibility of the free leg 24 and the re-direction of the force from the leg 23 that can be mounted in the opening 47 of the contact insert 14 to the moveable leg 24. Thus, the spring force element 11 contains means for attachment at the contact insert 14, with the means consisting of geometrically arranged support means 21 that consist primarily of slots in contact insert 14 into which protrusions 22 of the spring force element 11 engage. For engaging or mounting the spring force element 11 in the opening 47 of the u-shaped spring cage 45 of the contact insert 14, the contour of the leg spring 13 is designed such that two support means 21 that are located parallel and opposite to each other are arranged at the two longitudinal sides 26 of the leg spring 13 at the end of the leg 23 to be mounted. The support means consist of protrusions 22, where the shapes of the protrusions 22 are adapted to the shape of corresponding openings 47 in the contact insert 14 and in their cross-section correspond to a square or a rectangle, preferably to a rectangle.

Figure 3:
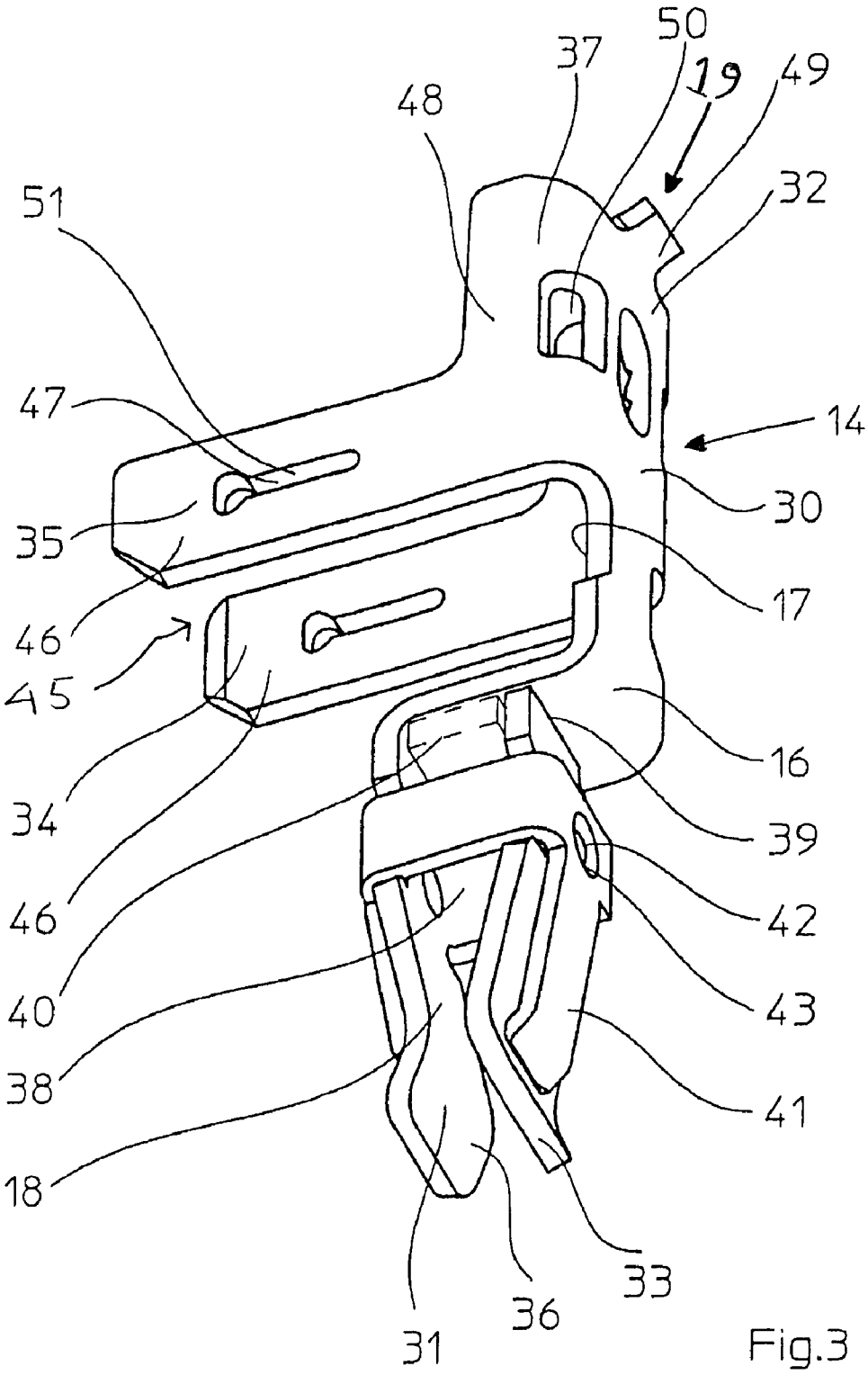
FIG. 3 is a perspective presentation of a contact element subject to the invention.

FIG. 3 is a perspective view of an advantageous embodiment of a contact insert 14 according to the invention of the kind in question for a plug-type connector 2. The contact insert 14 is made from a flat, electrically conductive strip of material. The contact insert 14 is punched out of the strip material in one piece and formed using bending technology, and forms the bus bar 16. The contour of the bus bar 16 consists from the point of view of processing essentially of a narrow web 30 with numerous end pieces 31, 32, 33, 34, 35 formed on it, whereby two end pieces 31, 32 are arranged on the center axis of the narrow web 30 that is formed of the strip material, each at an opposite end 36, 37. The end piece 31 is arranged above a leg 38 together with the end piece 33, which runs parallel to the end piece 31 and to the center axis of the narrow web 30. Both end pieces 31, 32 together form a contact element 18, which is designed as a socket contact and receives a contact pin 7, for example the contact pin of a base strip 5 (ref. FIG. 1).

The socket contact 18 can be equipped with an additional bracket 41 for increasing the clamping force as shown in FIG. 3. The bracket 41 surrounds the two end pieces 31, 33, whereby attaching the bracket 41 is carried out via an opening 42 that is pronounced at the outside of the end piece 31, 32 and engages in a bore hole 43 of the bracket 41. Other mounting options for the bracket 41 at the end pieces, such as riveting, for example, are conceivable. In one of the embodiments of a contact insert 14, the end piece 33 is connected to the bus bar 16 at the narrow side 39 that is located opposite the free end, preferably by welding with other mounting options conceivable as well. For example in that a 90 degree angled leg 40 (shown as a dashed line in FIG. 3) is arranged at the narrow side 39, where said leg counteracts the force occurring when opening the socket contact 18 through the contact pin 7. In this embodiment, the bracket 41 may be omitted.

The two end pieces 34, 35, which are arranged underneath the adjacent end piece 32 and above the contact element 18, form together with the end piece 32 a u-shaped spring cage 45. The spring cage 45 consists of two retaining clips 46 and a section of the bus bar 16, or the section of the bus bar 16 that serves as a contact area 17 for the electrical conductor 6 in the terminal point 9, with the two retaining clips 46 assuming the task of fastening the spring force element 11. Thus, the end piece 32 has several functions. The first function of the end piece 32 is that of providing the connection in the u-shaped section between the end pieces 34 and 35. The guide bars 48 arranged on the side of the end piece 32 fulfill additional functions. On the one side, they guide the moveable leg 24 of the spring force element 11 and on the other side they form a closed spring cage 45. At the same time, the two guide bars 48 that arranged parallel at a distance to each form the short "L" shaped leg (see dashed line) of the retaining clips 46, which also serve as a guide and as an electrical contact for the electrical conductor 6, with the retaining clips 46 forming the long "L" shaped leg. In addition, the guide bars 48 increase the strength of the bus bar 16 when absorbing loads, for example counteracting deflection, which is generated by the spring force element 11 in the retaining clips 46. Punched in the end piece 32 are also breakthroughs 50, preferably three breakthroughs 50, which have a positive effect in the shape forming process when producing the contact insert 14. An attachment means 19 arranged at the end piece 32, consisting of an angled snap-in hook 49, serves as a support function for the contact insert 14, while the two retaining clips 46 that are arranged parallel to each other and perpendicular to the center axis of the bus bar 16 serve for the attachment of the spring force element 11. To this end, the retaining clips 46 have openings 47 in which the support means 21 that consist primarily of protrusions 22 and are arranged at the spring force element 11 engage. The shape of the opening 47 in a retaining clip 46 forms a longitudinal hole 51, whereby the longitudinal hole 51 exhibits in its cross-section a square or a rectangle, preferably a rectangle. It also conceivable that two longitudinal holes 51 are arranged in one retaining clip 46. The width of the longitudinal hole 51 is determined by whether a material strip 12 of the spring force element 11 or a set of springs consisting of several leg springs 13 shall be employed. This means that the size of the opening 47 is produced corresponding to the material thickness of the spring force element 11 or is adapted to it.

REFERENCE CHARACTER LIST

1 Connecting terminal
2 Plug-type connector
3 Insulating housing
4 Printed circuit board
5 Base strip
6 Electrical conductor
7 Contact pin
8 Actuating means
9 Terminal point
10 Actuating tool
11 Spring force element
13 Leg spring
14 Contact insert
16 Bus bar
17 Contact area
18 Contact element
19 Attachment means
22 Protrusions
23 Leg (attached)
24 Leg (moveable)
25 Loop
26 Longitudinal side
27 Receiving space
28 Free
29 Free
30 Web
31 End piece
32 End piece
33 End piece
34 End piece
35 End piece
36 End
37 End
38 Leg
39 Narrow side
40 Leg (angled)
41 Bracket
42 Dish
43 Bore hole
45 Spring cage
46 Retaining clips
47 Openings
48 Guide bars
49 Snap-in hook
50 Breakthroughs
51 Longitudinal hole It is important to note that the present invention is not intended to be limited to a device which must satisfy one or more of any stated or implied objects or features of the invention. It is also important to note that the present invention is not limited to the preferred, exemplary, or primary embodiment(s) described herein. Modifications and substitutions by one of ordinary skill in the art are considered to be within the scope of the present invention, which is not to be limited except by the allowed claims and any legal equivalents thereof.

The invention claimed is:

1. A plug-type connector (2) for electrical contacting and for attachment to a printed circuit board (4) equipped with a base strip (5), for at least one electrical conductor (6), the connector having a housing made of insulating material (3) either in block or modular design, with at least one actuating means (8) made of synthetic material, with at least one spring force element (11), comprising a leg spring (13) that is punched out of and formed of a strip of material for clamping an electrical conductor (6), with at least one contact insert (14) that is punched out of and formed in one piece of an electrically conducting strip of material forming a bus bar (16), whereby the bus bar (16) is formed of numerous end pieces (31, 32, 33, 34, 35), wherein three end pieces (32, 34, 35) form a u-shaped spring cage (45), and wherein the bus bar (16) exhibits a contact area (17) for the electrical conductor (6) and a contact element (18) for plugging the connecting terminal (1) onto a contact pin (7) as well as attachment means (19) for mounting the at least one contact insert (14) in the insulating housing (3), characterized in that the spring force element (11) includes means for simultaneous physical and electrical attachment to said contact insert (14).

2. A plug-type connector (2) as claimed in claim 1, characterized in that the means for simultaneous physical and electrical attachment of said spring force element (11) to said contact insert (14) includes geometrically arranged retaining clips or legs (46).

3. A plug-type connector (2) as claimed in claim 1, characterized in that the means for simultaneous physical and electrical attachment of said spring force element (11) to said contact insert (14) includes protrusions (22).

4. A plug-type connector (2) as claimed in claim 3, characterized in that the protrusions (22) are designed with a rectangular or square cross-section.

5. A plug-type connector (2) as claimed in claim 1, characterized in that the spring force element (11) comprises a set of springs.

6. A plug-type connector (2) as claimed in claim 5, characterized in that the set of springs comprises at least two leg springs (13).

7. A plug-type connector (2) as claimed in claim 6, characterized in that the leg springs (13) used in the set of springs exhibit different contours.

8. A plug-type connector (2) as claimed in claim 1, characterized in that two end pieces (31, 32) are arranged on a center axis of the strip of material (15).

9. A plug-type connector (2) as claimed in claim 8, characterized in that the two end pieces (31, 33) form a contact element (18).

10. A plug-type connector (2) as claimed in claim 1, characterized in that an end piece (32) exhibits guide bars (48) on the side.

11. A plug-type connector (2) as claimed in claim 10, characterized in that the guide bars (48) serve as guide for a moveable leg (24) of the spring force element (11) and as guide for the electrical conductor (6).

12. A plug-type connector (2) as claimed in claim 1, characterized in that the end piece (32) includes breakthroughs (50).

13. A plug-type connector (2) as claimed in claim 1, characterized in that the attachment means (19) is arranged at the end piece (32).

14. A plug-type connector (2) as claimed in claim 13, characterized in that the attachment means (19) consists of a snap-in hook (49).

15. A plug-type connector (2) as claimed in claim 1, characterized in that the u-shaped spring cage (45) exhibits two retaining clips (46) for holding the spring force elements (11).

16. A plug-type connector (2) as claimed in claim 15, characterized in that the retaining clips (46) exhibit openings (47) for receiving protrusions (22) of the spring force element (11).

17. A plug-type connector (2) as claimed in claim 16, characterized in that a shape of the openings (47) forms a longitudinal hole (51).

18. A plug-type connector (2) as claimed in claim 17, characterized in that the longitudinal hole (51) has a rectangular cross-section.

19. A plug-type connector (2) as claimed in claim 18, characterized in that a size of the openings (47) corresponds to a material thickness of the spring force element (11).

* * * * *